US009179706B2

(12) United States Patent
Jespersen et al.

(10) Patent No.: US 9,179,706 B2
(45) Date of Patent: Nov. 10, 2015

(54) FILTER TIP, TUBES, AND CONES

(75) Inventors: Thomas Jespersen, Broendy (DK); Anders Overgaard Neilsen, Broendy (DK); Daniel S. Sinclair, Jr., Mandeville, LA (US)

(73) Assignee: Blunt Wrap U.S.A., Inc., Mandeville, LA (US)

( * ) Notice: Subject to any disclaimer, the term of this patent is extended or adjusted under 35 U.S.C. 154(b) by 938 days.

(21) Appl. No.: 13/291,628

(22) Filed: Nov. 8, 2011

(65) Prior Publication Data

US 2012/0138075 A1 Jun. 7, 2012

Related U.S. Application Data

(60) Provisional application No. 61/411,187, filed on Nov. 8, 2010.

(51) Int. Cl.

| | |
|---|---|
| ***A24D 3/02*** | (2006.01) |
| ***A24C 5/40*** | (2006.01) |
| ***A24D 3/04*** | (2006.01) |
| ***A24F 15/12*** | (2006.01) |

(52) U.S. Cl.
CPC ... *A24C 5/40* (2013.01); *A24D 3/02* (2013.01); *A24D 3/04* (2013.01); *A24F 15/12* (2013.01)

(58) Field of Classification Search
None
See application file for complete search history.

(56) References Cited

U.S. PATENT DOCUMENTS

| | | | |
|---|---|---|---|
| 5,657,773 | A | 8/1997 | George |
| 6,394,320 | B1 | 5/2002 | Feiman |
| 2006/0037622 | A1 | 2/2006 | Bachmann |
| 2010/0270303 | A1 | 10/2010 | Kesselman et al. |

FOREIGN PATENT DOCUMENTS

| | | |
|---|---|---|
| DE | 29811803 U1 | 2/1998 |
| DK | 200600078 | 6/2006 |
| GB | 2340375 | 2/2000 |
| GB | 2383252 | 6/2003 |
| WO | WO 97/21362 | 6/1997 |
| WO | WO 2006/016013 | 2/2006 |

OTHER PUBLICATIONS

"Learn How to Roll a Joint", Dec. 13, 2005, www.weedfarmer.com, accessed on Feb. 3, 2015 via:http://www.weedfarmer.com/joint_rolling/ and.*

"My way to make a perfect joint", Feb. 1, 2001, www.jointen.dk, accessed on Feb. 3, 2015 via:http://www.jointen.dk/bigjoint/jointrolling.html.*

* cited by examiner

*Primary Examiner* — Michael J Felton
(74) *Attorney, Agent, or Firm* — Brett A. North; Garvey, Smith, Nehrbass & North, L.L.C.

(57) ABSTRACT

A filter strip is provided for rolling sheets to construct custom cigars and/or cigarettes. The filter strip may be made of a deformable material which can be positioned on one end of the rolling sheet. The filter strip can be folded in a zig zag or spiral filter section with open section located longitudinally below to form a filter tip. The filter tip can assist the user in rolling by hand a substantially cylindrical or conical cigar or cigarette. The filter tip prevents tobacco filler material from being drawn through the cigar or cigarette and into a user's mouth, and permits the entire amount of tobacco filler to be consumed/smoked without risking burned hands and/or lips.

8 Claims, 13 Drawing Sheets

FILTER TIP, TUBES, AND CONES

CROSS-REFERENCE TO RELATED APPLICATIONS

This is a non-provisional of U.S. Patent Application Ser. No. 61/411,187, filed Nov. 8, 2010, which application is incorporated herein by reference and to which priority is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND

When using such conventionally shaped cigarette rolling paper to make or roll a cigarette by hand, the paper is first folded, bent or held in somewhat of a V-shape or U-shape with one of the sides of the "V" or "U" being longer than the other. An amount of smoking material, such as tobacco or the like, is distributed substantially over the entire length of the rolling paper in the bottom of the V- or U-shaped pouch formed by the rolling paper. The longer portion of the rolling paper, being free of any of the smoking material, is then bent or rolled over the portion of the rolling paper covered with the tobacco and is rolled over upon itself to form a substantially cylindrical shape. The longer end of the rolling paper is wrapped around itself as far as possible and overlaps an underlying layer to form part of the wall of the cylinder.

The rolling process, when performed by hand, requires a keen eye, a steady hand, and a high degree of digital dexterity, since the rolling paper is not very large compared to a human hand, since the particles of smoking materials tend to roll or slide off the small rolling paper, and since the rolling paper itself is very thin and easily ripped or torn. A critical step of rolling a cigarette by hand is using ones fingers to both form the "V" or "U" shaped pouch for the smoking material, and to roll the longer portion of the rolling paper around itself. During the process of rolling the longer portion of the paper around itself, the user depends on the trapped smoking material to provide the generally cylindrical shape to guide placement of the longer portion around itself to produce a generally cylindrical cigarette.

Oftentimes, however, the use of smoking material to guide placement of the longer portion around itself does not aid in producing a cylinder due to either poor distribution of smoking material along the V- or U-shaped pouch, causing the longer portion to be rolled too tight or too loose around itself, with respect to the majority portion of the smoking material, or due simply to the user's inability to correctly manipulate or spiral the cigarette rolling paper around itself between their fingers. The result of either of these situations can be an unsmokable cigarette, a cigarette that falls apart, or a cigarette that is torn, which also has the effect of making the cigarette unsmokable.

Cigarettes that are rolled by hand using conventional cigarette rolling paper do not include filters or other means for preventing the smoking material from being drawn into the users mouth. One method that is used to prevent smoking material from being drawn into a users mouth has been to restrict the size of the opening by pinching or twisting the end of the rolling paper upon itself. While this method is somewhat effective at reducing passage of smoking material from the cigarette, it also restricts the amount of air that can be drawn through the cigarette, and this restricts consumption of the smoking material. Restricting the cigarette air passage also requires a larger effort by the smoker that reduces smoking pleasure.

Cigarettes that are rolled using conventional cigarette rolling paper also do not permit complete use of the smoking material disposed within because the cigarette can only be smoked until the lit end approaches the user's fingers or lips during holding or smoking, the cigarette must be dispensed, and at which time a user's fingers or lips may be burned.

It is, therefore, desirable that a method and apparatus be provided for cigarette rolling paper be constructed in a manner that assists the user in rolling a cigarette by hand. It is material from being drawn from the cigarette into a smoker's mouth. It is also desirable that the cigarette rolling paper be constructed in a manner that permits the entire smoking material to be smoked without the risk of burned fingers or burned lips. It is further desirable that the cigarette rolling paper be constructed from conventional materials using conventional techniques.

A segment of the smoking population enjoys smoking hand rolled cigars or cigarettes. Typically, these individuals purchase rolling papers, tobacco leaves or cigar wrapping materials and hand roll their preferred brand of crushed tobacco, or herbs such as cloves, into a custom-made cigarette or cigar. The result is a personally customized tobacco or herbal product with superior smell and taste than a prefabricated store bought product. Hand fabricating cigars or cigarettes is time consuming and requires finger dexterity and skill.

Prior art includes tobacco products formed by rolling moistened tobacco leaves about a cylindrical form casing to form a shell whereby a consumer can fill the shell with crushed tobacco. In one embodiment of the prior art a slit is formed through a wall of the shell to allow prying open of the shell to insert the crushed tobacco. The slit must then be closed and sealed again prior to smoking the product. In another embodiment, a funnel is used to deposit the crushed tobacco into the ends of the cylindrical shell.

Disadvantages of these prior art tobacco products include: extended time and requisite finger dexterity required to place crushed tobacco in the end openings of a prefabricated cylindrical shell; extended time and requisite finger dexterity required to pry open a slit in the prefabricated shell and place crushed tobacco into the shell; wasted tobacco or herbal product resulting from the end, or butt, of the cigar or cigarette becoming unholdable due to increased temperatures as the product burns during consumption; tobacco debris sucked through the end of the tobacco product during consumption that ends up in the mouth or respiratory system of the consumer; fast burn rates at the end of the cigar the consumer lights—the end many consumers assert has the best flavor and is most enjoyable; and uneven distributions of nicotine—the result of a generally cylindrically shaped product burning during consumption.

While certain novel features of this invention shown and described below are pointed out in the annexed claims, the invention is not intended to be limited to the details specified, since a person of ordinary skill in the relevant art will understand that various omissions, modifications, substitutions and changes in the forms and details of the device illustrated and in its operation may be made without departing in any way from the spirit of the present invention. No feature of the invention is critical or essential unless it is expressly stated as being "critical" or "essential."

BRIEF SUMMARY

One embodiment provides an improved method of constructing a cigarette or cigar.

One embodiment relates to an improved method of fabricating a cigarette or cigar. More particularly, one embodiment relates to an improved method of fabricating a cigar that provides a frusto-conically shaped smoking article that includes a filter tip.

One embodiment provides a method and apparatus for creating a custom cigar or cigarette having a filter tip which filter tip has a filter area and a open area.

One embodiment provides a filter strip which provides the user the option of creating a filter tip a filter area but with or without an open area.

One embodiment can be used with conical tubes. One embodiment can be used with cylindrical tubes.

Conventionally, cigarette rolling sheets can be made from thin, tissue-like paper having a quadrilateral shape with sides of between one and four inches in length, and usually between 2.5 to 3.5 inches in length.

One embodiment provides the filter tip allowing, after being used to assist in forming a cylindrical cigarette, acts as a filter to minimize or eliminate the passage of smoking material through the cigarette and into a user's mouth during smoking. The spiraled configuration of the rolled rolling strip forms a continuous spiral-shaped channel, if viewed in cross section, having a narrow channel opening defined by opposing frontside and backside rolling strip surfaces. The narrow channel opening serves to minimize or prevent the passage of smoking material therethrough when the cigarette is being smoked.

One embodiment provides the filter tip allowing for the consumption of the entire amount of the smoking material. Unlike cigarettes formed from conventional cigarette papers, a user smoking a cigarette formed from cigarette rolling papers of this invention is able to consume the entire amount of smoking material without the need to use external devices, such as clips and the like, and without the risk of burned fingers or lips. The rolled rolling strip acts to insulate the smokers lips and fingers from the combustible smoking material.

In one embodiment each cone or tube can have proximal and distal end portions, each having an opening.

In one embodiment the method can include nesting of one cone or tube inside the other cone or tube.

In one embodiment, the nested cones or tubes are partially filled.

In one embodiment, the container can be cylindrically shaped.

In one embodiment, the container can be conically shaped.

In one embodiment, the container can be a package with a flat portion.

In one embodiment, the tubes are removed from the package, enabling the forming of multiple new cigars by disassembling the tubes. A smoker forms multiple new cigars using a tube for each new cigar and a smoker's custom tobacco as a filler material.

In one embodiment, is provided a smoking article having a storage container with an open end portion and an interior. A cap removably attaches to the container at the open end portion. At least a pair of cones can be nested one inside the other, each cone having a proximal opening and a distal opening.

In one embodiment is provided a mouthpiece which attaches to the nested cones, the mouthpiece having internal threads that threadably engage one of the cones. In one embodiment at least one of the cones is expandable to provide a larger diameter distal opening.

In any of the described embodiments is provided a method of offering for sale a customizable tobacco product comprising the steps of providing a packaged tobacco product, offering for sale the tobacco product, the tobacco product including instructions for making a finished tobacco product. In various embodiments the instructions are one or more steps shown in the individual embodiments for making a finished cigar.

One embodiment relates generally to rolling sheets and, more particularly, to a filter tip combined with a cigarette rolling sheets that serves to facilitate hand rolling of the sheets, and that additionally serves as both a filter and a holder when the cigar or cigarette is rolled and smoked.

In one embodiment is provided a method of making a custom cigar or cigarette comprising the steps of:

(a) providing a filter tip, the filter tip having first and second ends, the first end being a filter end, the second end being an open area;

(b) proving a smokable sheet of material having first and second ends;

(c) placing the filter tip on the sheet of material and rolling the sheet of material around the filter tip.

The hollow conical shape of the product allows for the easy insertion of the smokable substance. The hollow conical shape further permits easy insertion of larger amounts of smokable substances into the end of the product the consumer lights, resulting in an initial slower prolonged burn and more even distribution of nicotine. Additionally, the placement of a structure into one end of the hollow cone permits the consumer to consume the majority, if not all, of the smokable substance. This structure further prevents debris and other unwanted materials from being sucked through the end of the product and into the mouth and respiratory system of the consumer. The result is a product that is easy to use and provides for a superior smoke.

In one embodiment is provided a smokable apparatus comprising a first sheet (or sheets) of material, the sheet (or sheets) forming a hollow cone, the hollow cone having a first end defining a first opening and a second end defining a second opening whereby the second opening has a diameter greater than the diameter of the first opening. The first sheet (or sheets) of material is comprised of tobacco, homogenized tobacco and/or natural leaf materials.

In one embodiment may be included a filter tip having first and second longitudinal ends with the first end having a filtering area and the second end being open.

In one embodiment is provided a method of making a custom cigar or cigarette comprising the steps of:

(a) providing a filter tip, the filter tip having first and second ends, the first end being a filter end, the second end being an open area;

(b) proving a smokable sheet of material having first and second ends;

(c) placing the filter tip on the sheet of material and rolling the sheet of material around the filter tip.

One embodiment includes a method of creating a custom cigar or cigarette comprising the steps of:

(a) providing a first sheet (or sheets) of material, the first sheet of material comprised of tobacco, homogenized tobacco and/or natural leaf material;

(b) cutting the first sheet (or sheets) of material to a desired size; and forming the first sheet (or sheets) into a hollow cone, the hollow cone having a first end defining a first opening and a second end defining a second opening whereby the second opening has a diameter at least 1.25 times greater than the diameter of the first opening;

(c) providing a filter tip having first and second longitudinal ends, the first longitudinal end having a filter area and the second longitudinal end being open; and (d) placing the filter tip within the first end of the hollow cone, wherein the first end of the filter tip is more closely placed to the second end of the cone, and the second end of the filter tip is more closely place to the first end of the cone.

One embodiment includes a method of creating a custom cigar or cigarette comprising the steps of:

(a) providing a first sheet (or sheets) of material, the first sheet of material comprised of tobacco, homogenized tobacco and/or natural leaf material;

(b) cutting the first sheet (or sheets) of material to a desired size; and forming the first sheet (or sheets) into a hollow cone, the hollow cone having a first end defining a first opening and a second end defining a second opening whereby the second opening has a diameter at least 1.25 times greater than the diameter of the first opening;

(c) providing a filter tip having first and second longitudinal ends, the first longitudinal end having a filter area and the second longitudinal end being open;

(d) placing the filter tip within the first end of the hollow cone, wherein the first end of the filter tip is more closely placed to the second end of the cone, and the second end of the filter tip is more closely place to the first end of the cone; and (e) after step "d" packaging for sale the hollow cone with filter tip.

One embodiment provides cigarette rolling paper kit comprising a sheet of cigarette paper having a frontside surface and a backside surface. The sheet can be a conventional cigarette paper of rectangular configuration, having an adhesive section or strip extending lengthwise along an edge of the frontside surface. The cigarette rolling paper kit can include a filter tip having open and filtering longitudinal sections, which can be placed on the frontside surface of the sheet for assisting in the formation of a substantially cylindrical cigarette by hand.

The filter tip is preferably in the form of a strip of deformable material. In one embodiment the strip can be rectangular.

In one embodiment is provided a cigarette is formed by rolling the free end of the strip about itself into a spiral, and bending the sheet around the rolled strip to form a U-shaped pouch. Smoking material is disposed within the pouch and the sheet is rolled over the rolled strip and smoking material so that its backside surface interfaces with its frontside surface to form a cylinder. The adhesive section is activated and sealed against the backside sheet surface to form a cylindrical cigarette.

In one embodiment the filter tip: (1) assists the user in forming a cylindrical cigarette; (2) prevents smoking material from being drawn through the cigarette and into a user's mouth; and (3) permits the entire amount of smoking material to be consumed without risking burned hands and/or lips.

FIG. 4 illustrates the steps of an embodiment of the method provided by the invention. This method may be used to produce the product for the consumption of smokable substances illustrated in FIG. 1.

First is provided a first sheet (or sheets) of material. The first sheet (or sheets) of material comprised of tobacco, homogenized tobacco and/or natural leaf materials such as plant leaves (e.g., banana, palm leaves, etc.) and the like.

Second, the first sheet (or sheets) of material to a desired size.

Third, the first sheet (or sheets) into a hollow cone, the hollow cone having a first end defining a first opening and a second end defining a second opening whereby the second opening has a diameter greater than the diameter of the first opening.

Forming the first sheet (or sheets) into the hollow cone may be accomplished by hand or by utilizing a mold of a predetermined length and end diameters, whereby the first sheet (or sheets) of material are wrapped or rolled around the outside of the mold and then slightly compressed to cause them to adhere together. Alternatively, molds may be inserted into the first and/or second ends of the hollow cone after it has been formed. The mold, or molds, will cause the hollow cone to retain its shape. Additionally and/or alternatively an adhesive, such as glue, may be applied to the first and second ends of the hollow cone. The adhesive will assist in causing the hollow cone to retain its shape. Further, a small amount of moisture may be added to the first sheet (or sheets) of material to make it more pliable prior to forming the hollow cone. Once the hollow cone has been formed around the mold, or the molds have been inserted into the ends of the hollow cone, it is allowed to dry. When substantially dry, the hollow cone may be removed from the mold. To assist in removal of the dried hollow cone from the mold, the outer surface of the mold may be pre-coated with a non-stick material.

Fourth, is provided a filter tip having first and second longitudinal ends, the first longitudinal end having a filter area and the second longitudinal end being open and placing the filter tip within the first end of the hollow cone, wherein the first end of the filter tip is more closely placed to the second end of the cone, and the second end of the filter tip is more closely place to the first end of the cone Providing the filter tip may be performed at the same time as providing the cone, such as where the filter tip may be used in rolling the cone, whereby when the cone is formed (by hand, around a mold, etc.) the filter tip is disposed within the smaller diameter end of the cone. When these two steps are performed simultaneously, a portion of the filter tip may be attached to the inner surface of the first sheet (or sheets).

Fifth, the hollow cone with filter tip is packaged for sale in a container. The container may be comprised of any material having adequate strength to protect the cone from being crushed. Additionally, an elongated member, such as a bamboo stick may be packaged with the hollow cone.

In one embodiment flavoring and/or moisture to the first sheet of flammable material (by methods known to one skilled in the art such as spraying a mist, brushing or dipping the sheets of flammable material into a vat of hydrant or flavor mixture, etc.) may be done at any time prior to packaging.

In various embodiments filter tips of various styles and designs are contemplated.

In various embodiments conically or cylindric rolled paper or tobacco tubes of various styles and designs are contemplated.

In one embodiment filter strips in rectangular and square booklets are provided.

In one embodiment semicircular filter strips in conical booklets are provided.

In one embodiment rectangular or square filter strips which can form cylindrical filter tips are provided.

In one embodiment, drilled filter strips (either conical/semicircular or rectangular in shape) having drilled portions are provided.

In one embodiment is provided filter strips in various sales units aimed for consumers, plastic bags, pouches, tins, cans, boxes, etc.

In various embodiments the filter strips can be comprised of cardboard, paper, and/or tobacco.

In one embodiment is provided a filter tip is provided which can be made from a flat filter strip comprising a partly circular cut piece of paper/cardboard (we can reduce this to a specific circular angle-range/approx. one-sixth (⅙) of a 360 degree angle) intended for manual (or machine) rolling into a conical shaped tube with a commercial purpose, intended for use with or in combination with cigarette paper sheets (rice, flax, hemp, wood, etc)/or homogenized manufactured sheets, which contains percentages of tobacco.

In one embodiment is provided a completed filter tip having filter and open longitudinal portions.

In one embodiment the filter tip can function as a mouth piece preventing tobacco filler from the interior of the rolled cigar or cigarette from passing through the filter tip, while allowing the user to draw through the filter tip and enjoy the tobacco product.

In one embodiment is provided a filter strip having perforated (die cut) lines; or marked (printed) lines aimed for rolling in a "spiral" pattern or folding in a "zig-zag" pattern that can be inserted in a conical or cylindric tube during the rolling process, or inserted after the rolling process.

In one embodiment is provided conically or cylindric rolled tubes for filling with tobacco filler material rolled about a filter tip which can include:

(a) Conically shaped cigar or cigarette tubes with filter tip with either (1) traditional conical filter tip or a (2) filter tip having longitudinal filter and open sections.

(b) Cylindrically shaped cigar or cigarette tubes with filter tip with either (1) traditional conical filter tip or a (2) filter tip having longitudinal filter and open sections.

In various embodiments the filter strips and/or filter tips can be made from cardboard/paper or tobacco related materials.

In various embodiments the wrapping sheets (e.g., wrapped around the filter tip) and can be made from cardboard/paper or tobacco related materials.

In various embodiments the filter tip includes a zig-zag shaped filter section and open section. In various embodiments the filter tip can be conical in shape.

In various embodiments the filter strip can have perforations, drill lines, or etched lines to create fold sections.

In various embodiments the filter strip can have a removable section which is removable by perforations and/or drill lines.

Drilled and/or perforation lines assist in folding.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION

Filter Strip

Figure 1:
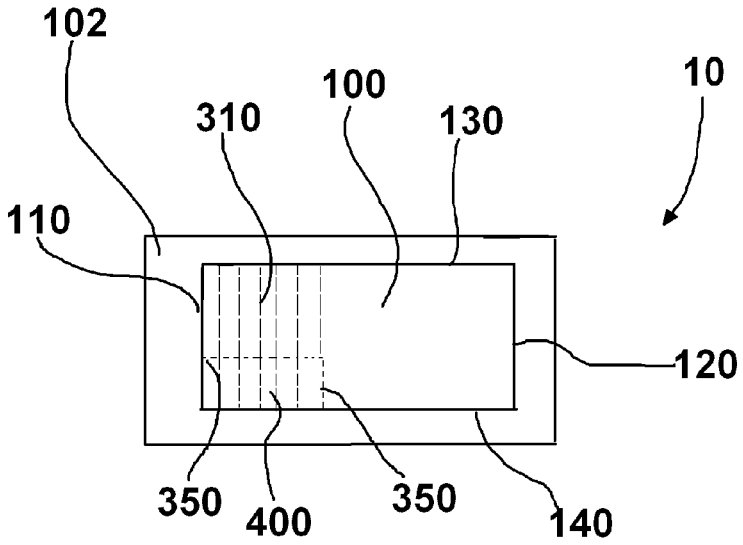
FIG. 1 is a top view of a rectangular filter strip having a removable portion and fold lines stamped in an encasing sheet.
Figure 2:
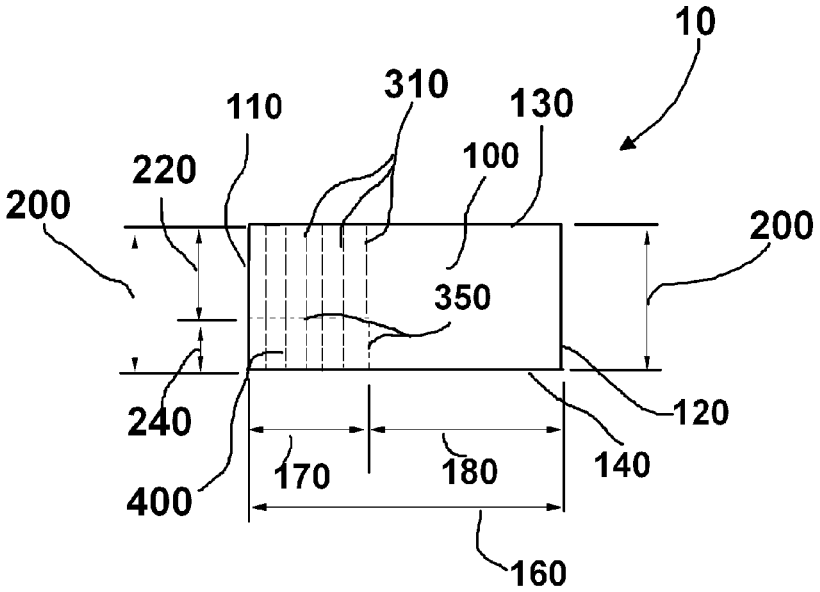
FIG. 2 is if the filter strip of FIG. 1 removed from the encasing sheet.

As shown in FIGS. 1-4, filter strip 100 can be configured in the shape of a rectangular strip having a length 160 and width 200. FIG. 1 is a top view of a filter rolling strip 100 which is punched in an encasing form 102. FIG. 2 is a top view of the filter rolling strip 100 after it has been removed from the encasing form 102.

Filter strip 100 can have sides 110, 120, 130, and 140, and can include a removable portion 400. A plurality of perforation, etched, or fold lines 310 can be included.

Filter strip 100 can be formed from a pliable and deformable material, such as paper, plastic, metal and the like, that is capable of retaining a folded and/or spiral shape when rolled upon itself from one end. In a preferred embodiment, the filter strip 100 can be formed from a material is relatively less flammable than sheet 600 (shown in FIGS. 11 and 12) and/or the tobacco filler 1150 so that when all of the tobacco filler material has been consumed the cigar or cigarette becomes extinguished.

Figure 11:
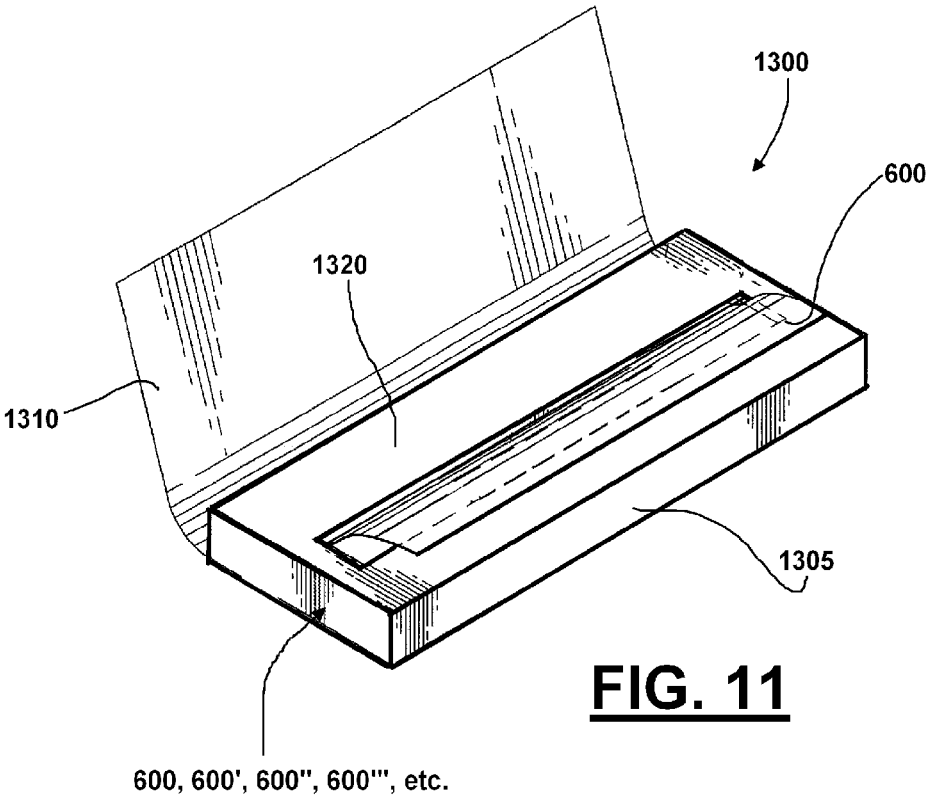
FIG. 11 is a carton of cigarette papers which can be used with one or more of the filter tips.
Figure 12:
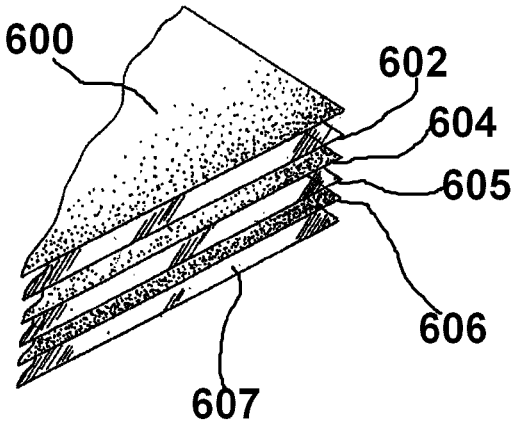
FIG. 12 is a perspective view of a stack of smokable sheets which can be used with one or more of the filter tips.

Filter strip 100 can be formed from paper, having a thickness greater than the thickness of sheet 600 (shown in FIGS. 11 and 12). The ratio of the thickness of strip 100 to the thickness of sheet 600 can be about 1.1, 1.2, 1.25, 1.3, 1.4, 1.5, 1.6, 1.75, 1.8, 1.9, 2.0, 2.25, 2.5, 2.75, 3.0, 3.5, 4.0, 4.5, 5.0, 6, 7, 8, 9, and 10. In various embodiments the ratio can be a range between any two of the above referenced ratios.

Filter strip 100 can be of a rectangular or square shape as shown in FIGS. 1-4. Alternatively filter strip 100 can be curved as shown in FIGS. 5-8.

Side 110 can have a height 200, which height can be broken into heights 220 and 240.

Height 240 can be greater than height 220. In various embodiments the ratio of the heights can be about 1.1, 1.2, 1.25, 1.3, 1.4, 1.5, 1.6, 1.75, 1.8, 1.9, 2.0, 2.25, 2.5, 2.75, 3.0, 3.5, 4.0, 4.5, 5.0, 6, 7, 8, 9, and 10. In various embodiments the ratio can be a range between any two of the above referenced ratios.

Side 130 can have a length 160, which length can be broken into lengths 170 and 180.

Length 180 can be greater than length 170. In various embodiments the ratio of the lengths can be about 1.1, 1.2, 1.25, 1.3, 1.4, 1.5, 1.6, 1.75, 1.8, 1.9, 2.0, 2.25, 2.5, 2.75, 3.0, 3.5, 4.0, 4.5, 5.0, 6, 7, 8, 9, and 10. In various embodiments the ratio can be a range between any two of the above referenced ratios.

Figure 3:
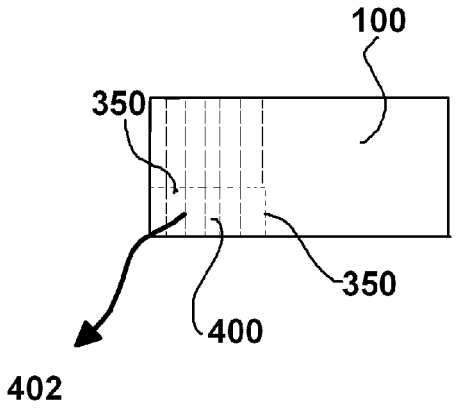
FIG. 3 is a top view of the filter strip of FIG. 1, schematically indicating the removal of the removable portion.
Figure 4:
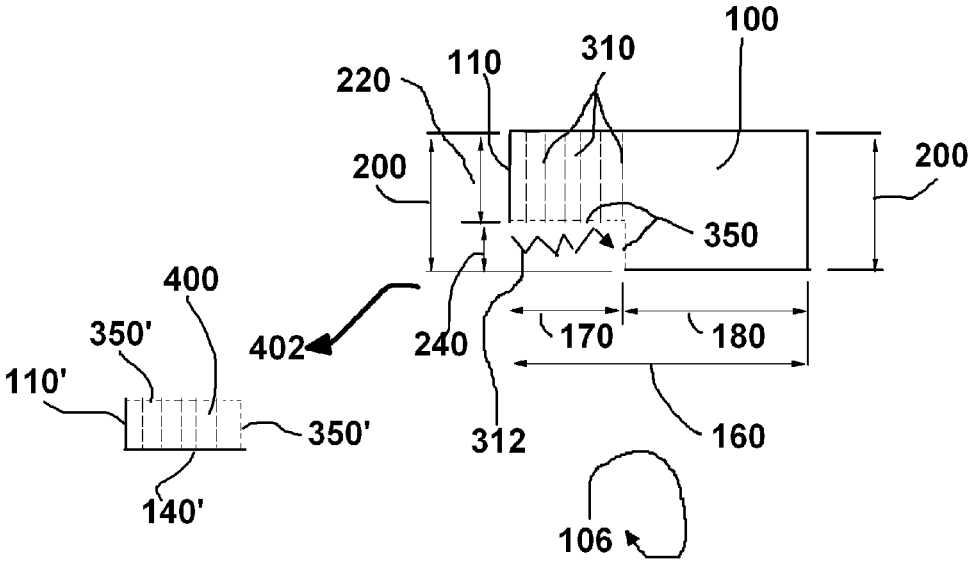
FIG. 4 is a top view of the filter strip of FIG. 1 with the removable portion removed, and the removable portion on the side of the filter strip.
Figure 7:
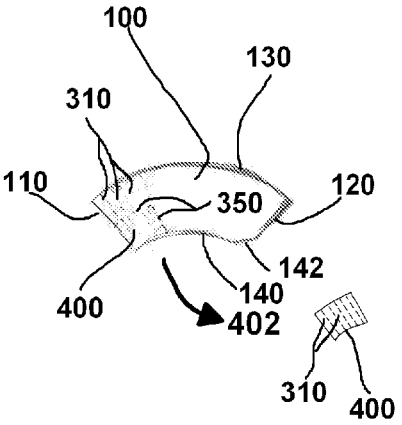
FIG. 7 is a top view of the semicircular filter strip of FIG. 5, schematically indicating removal of the removable portion, showing with the removable portion removed, and the removable portion on the side of the filter strip.

FIG. 3 shows strip 100 of FIG. 2 schematically indicating (arrow 402) that removable portion 400 is being removed from strip 100. As shown in FIGS. 4 and 7, the rolling strip 100 can have removable portion 400. FIG. 4 shows strip 100 with removable portion 400 removed and leaving the remaining portion of strip 100. FIG. 7 shows strip 100 with the removable portion 400 removed (schematically indicated by arrow 402) and leaving the remaining portion.

Figure 9:
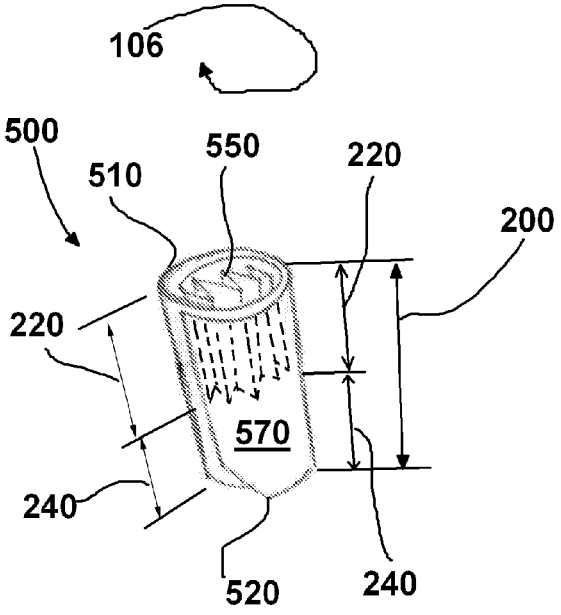
FIG. 9 is a cylindrical filter tip fabricated from the filter strip of FIG. 1.
Figure 13:
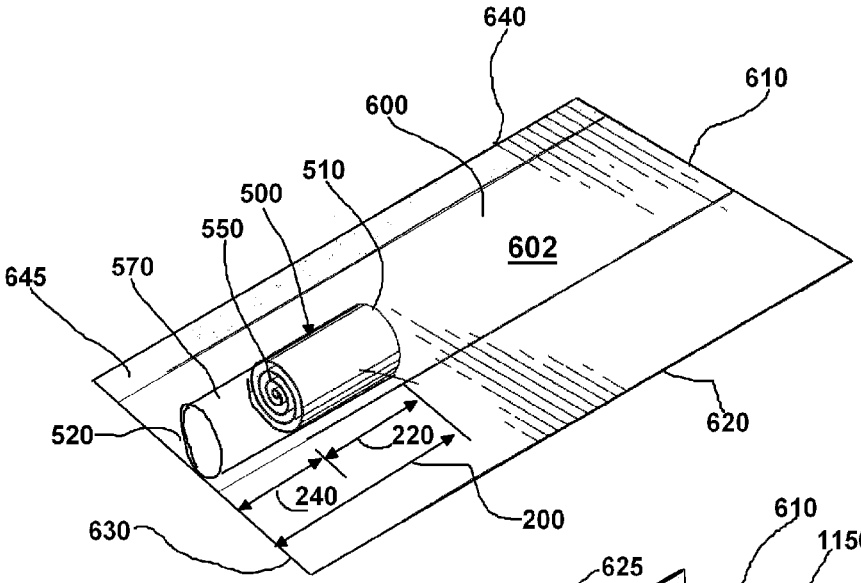
FIGS. 13-15 schematically indicate the steps of preparing a cigarette or cigar with the filter tip shown in FIGS. 1-3.

In one embodiment filter section 550 of cylindrical filter tip 500 can be folded similar to a hand fan as shown in FIG. 9. In one embodiment filter section 550 can be spirally rolled as shown in FIG. 13.

In forming filter tip 500, as schematically indicating in FIG. 4, length 170 of filter strip 100 can be folded upon itself (such as by using perforation or fold lines 310 to assist in the folding and schematically indicated by zig zag arrow 312). Length 170 can be placed between a users thumbs and forefingers and is folded alternatively (or in an undulating manner) toward length 180. The number of times that length 170 of filter strip 100 can be folded upon itself depends both on length 170, and the size of the folds (e.g., the distance between fold lines 310).

After the folding of length 170, length 170 and length 180 are then rolled upon themselves (schematically indicated by arrow 106) until filter tip 500 is formed as shown formed in FIG. 9.

FIG. 9 shows a substantially cylindrical finished filter tip 500 which can include first end 510, second end 520 and have a height 200. Filter tip 500 can include filter section 550 having a height 220 and open section 570 having a height 240. Height 220 and height 240 correspond to the same numbered heights in filter strip 100 shown in FIGS. 1-4.

Finished filter tip 500 can be either cylindrical or conical. If filter tip 500 is to be conical it is preferred that semicircular filter strip 100 shown in FIGS. 5-8 be used to form filter strip 100.

Figure 5:
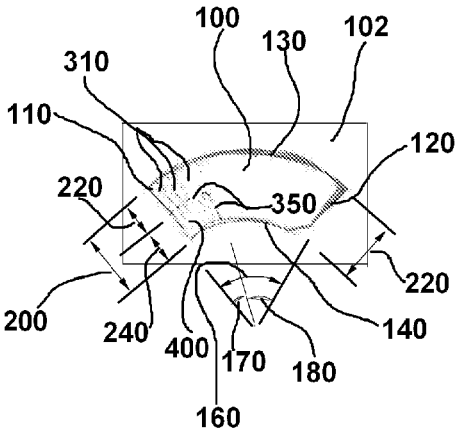
FIG. 5 is a top view of a semi-circular filter strip having a removable portion and fold lines stamped in an encasing sheet.
Figure 6:
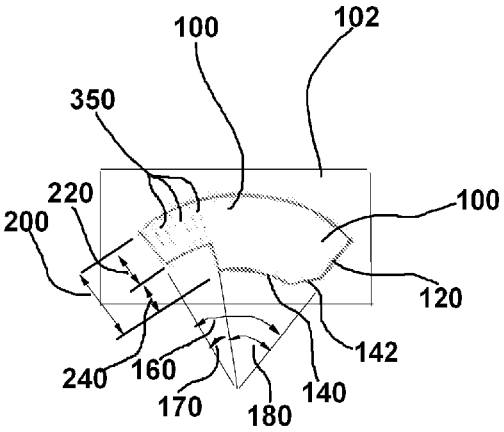
FIG. 6 is a top view of semicircular filter strip with filter tab and located inside an encasing sheet.
Figure 8:
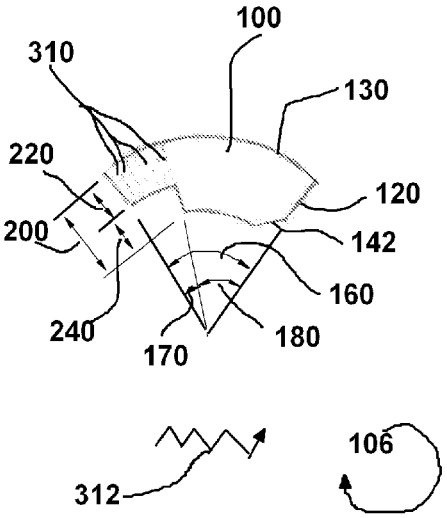
FIG. 8 is a top view of the filter strip of FIG. 5 with the removable portion removed.

FIG. 5 is a top view of semicircular filter strip 100 which is punched in an encasing form 102 having a removable portion 400. FIG. 6 is a top view of semicircular filter strip 100 which is punched in an encasing form 102 having a narrowed portion 240 removed. FIG. 7 shows semicircular filter strip 100 FIG. 6 with a removable portion 400 being removed from the remaining portion (removal schematically indicated by arrow 402). FIG. 8 shows semicircular filter strip 100 with the removable portion 400 now removed.

Figure 10:
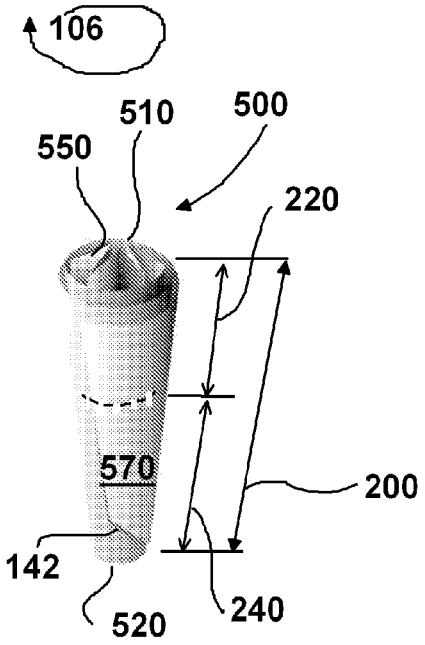
FIG. 10 is a conical filter tip fabricated from the filter strip of FIG. 5.

In one embodiment filter section 550 of conical filter tip 500 can be folded similar to a hand fan as shown in FIG. 10. In one embodiment filter section 550 of semicircular filter strip 100 can be spirally rolled as shown in FIG. 13.

In forming conical filter tip 500, as schematically indicating in FIG. 8, radial length 170 of filter strip 100 can be folded upon itself (such as by using perforation or fold lines 310 to assist in the folding and schematically indicated by zig zag arrow 312). Arc length 170 can be determined by the radius from radius of curvature of semicircular filter strip 100 to the middle of height 220 multiplied by the angle measurement in radians of radial length 170. Arc length 180 can be determined by the radius from radius of curvature of semicircular filter strip 100 to the middle of height 220 multiplied by the angle measurement in radians of radial length 180. Such arc lengths will give an average arc length between the bottom of height 220 to the top of height 220.

Radial length 170 can be placed between a users thumbs and forefingers and is folded alternatively (or in an undulating manner) toward radial length 180. The number of times that radial length 170 of filter strip 100 can be folded upon itself depends both on radial length 170, and the size of the folds (e.g., the distance between fold lines 310).

After the folding of radial length 170, radial length 170 and radial length 180 are then rolled upon themselves (schematically indicated by arrow 106) until filter tip 500 is formed as shown formed in FIG. 10.

Rolling Sheets or Cigarette Papers

FIGS. 11 and 12 show sheets or papers that can be used with filter tip 500 to make finished cigars or cigarettes.

FIG. 11 shows a carton 1300 of cigarette papers 600, 600', 600", etc. which can be used with one or more of the filter tips 500 to form a finished cigar or cigarette. FIG. 12 is a perspective view of a stack of smokable sheets which can be used with one or more of the filter tips.

Cigarette rolling papers can be stored and packaged in a cigarette rolling paper carton 1300 having a rectangular box-shaped base 1305 and dispensing opening 1320.

Sheet 600 can have a length consistent with conventional cigarette paper sheets, e.g., in the range of from about one to four inches. In a preferred embodiment sheet 600 can be about 2.75 inches by 1.5 inches, and 3 inches by 2 inches. It is, however, to be understood that these dimensions are provided for purposes of reference and illustration, and can be other than that specifically described.

Sheet 600 can include a section or strip 645 of adhesive, glue or moisture-activated gum disposed on a frontside sheet surface at a position adjacent a edge 640. Adhesive section 645 extends a distance from edge 640 towards edge 620. In a preferred embodiment, the adhesive section 645 has a width of approximately 3/16 inches, (e.g., extends away from the edge 640 approximately 3/16 inches), and is formed from a moisture-activated gum.

Moisture and flavors may be added (by methods known to one skilled in the art such as spraying a mist, brushing or dipping the sheets of flammable material into a vat of hydrant or flavor mixture, etc.) to sheets 600 etc.

In an example embodiment, sheet 600 has a length 620 of approximately 2.75 inches and a width 610 of approximately 1.5 inches, rolling strip 100 is approximately 0.75 inches wide 200 by 1.25 inches long 160. In another example embodiment, sheet 600 has a length 620 of approximately 3 inches and a width 610 of approximately 2 inches, rolling strip 100 is approximately 0.75 inches wide 200 by 1.75 inches long 160.

Hand Rolling a Finished Cigarette or Cigar

Figure 14:
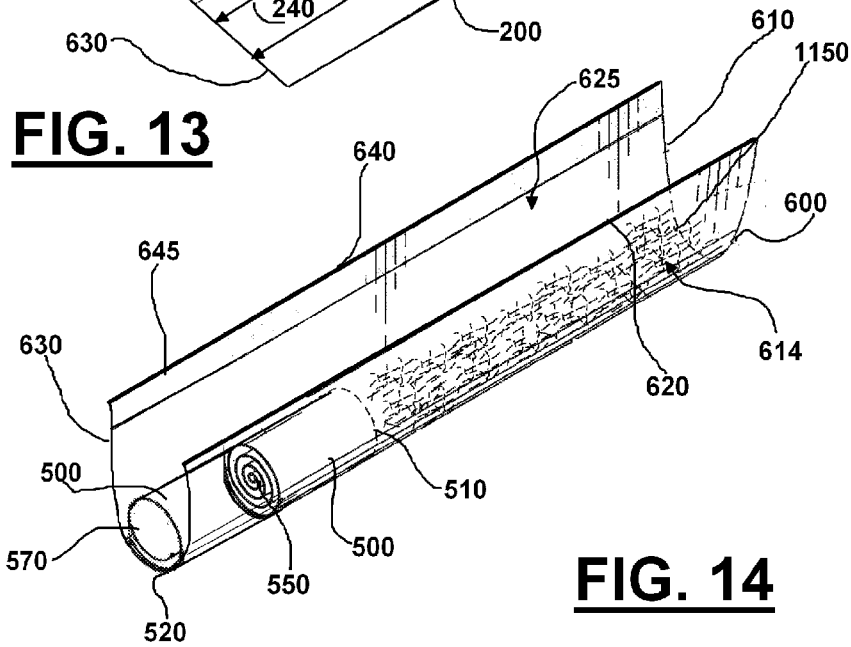
Figure 15:
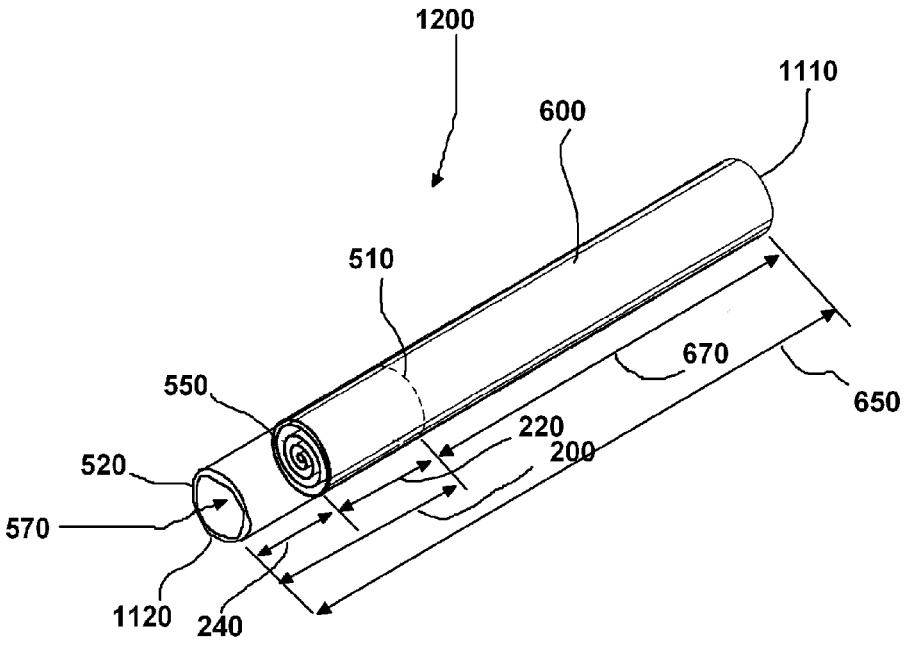

FIGS. 13-15 schematically indicate the steps of preparing a cigarette or cigar with filter tip 500.

It is desired that the height 200 of filter tip 500 be sufficient so that, when rolled to assist in forming the rolled cigarette or cigar, filter tip 500 provides a sufficient distance between a tip of the cigarette or cigar and the smoking material to prevent ones fingers or lips from being burned during holding or smoking the cigarette. In one embodiment filter tip 500 has a sufficient height 200 to assist or guide the user in rolling sheet 600 upon itself into a cylinder or cone.

As shown in FIGS. 13-15, sheet 600 can be rolled over filter tip 500. Sheet 600 can be a rectangular sheet of conventional cigarette paper, homogenized tobacco, and/or natural leaf tobacco.

Filter tip 500 (with a spiral filter section 550' compared to a folded filter section 550) should be placed close to the longitudinal centerline of sheet 600 (FIG. 13) and sheet 600 is rolled or bent around an outside surface of filter tip 500 to form a U-shaped or V-shaped pouch extending longitudinally from side 630 to side 610.

During this step, filter tip 500 can act as a guide to assist the user in forming a generally U-shaped pouch not only along the section of sheet 600 that is placed into direct contact with the outside surface of filter tip 500. The ability to form a generally U-shaped pouch is desired as it increases the user's ability to form a cigarette having a substantially cylindrical or conical configuration.

Tobacco filler material 1150' is placed within the formed pouch 625 between first end 510 of filter tip 500 and side 610 of sheet 600. Once the desired amount of tobacco filter material 1150' is placed into pouch 625, the user uses filter tip 500 as a guide to roll side 620 of sheet 600 around both filter tip 500 and the volume of tobacco filler material 1150'.

Continuing in this manner, filter tip 500 assists the user in rolling sheet 600 in substantially cylindrical or conical form, by allowing user to roll side 640 over side 620 and use adhesive strip 645 to form a seal for the rolled cigarette or cigar. The step of rolling side 640 of sheet 600 around filter tip 500 and tobacco filler material 1150' is continued so that the side 620 becomes tucked between the front 612 of sheet 600, on one side, and filter tip 500 and tobacco filler material 1150', on an opposite side. A rear surface 614 of sheet 600 interfaces with and is rolled against the front 612 about filter tip 500 and tobacco filler material 1150', and toward side 640 until only the adhesive section 645 remains exposed.

During the hand rolling process of rolling sheet 600, filter tip 500 acts as a guide that is used between the fingers of a user to assist in the formation of a finished cigarette or cigar. Optional adhesive strip 645 on sheet 600 can be activated by conventional means, e.g., if the adhesive section is a moisture-activated gum it is activated by licking, and rolling of the cigarette rolling paper is continued so that the adhesive section is sealed against an adjacent rear 614 to form a cigar or cigarette 1200 as shown in FIG. 15.

Figure 16:
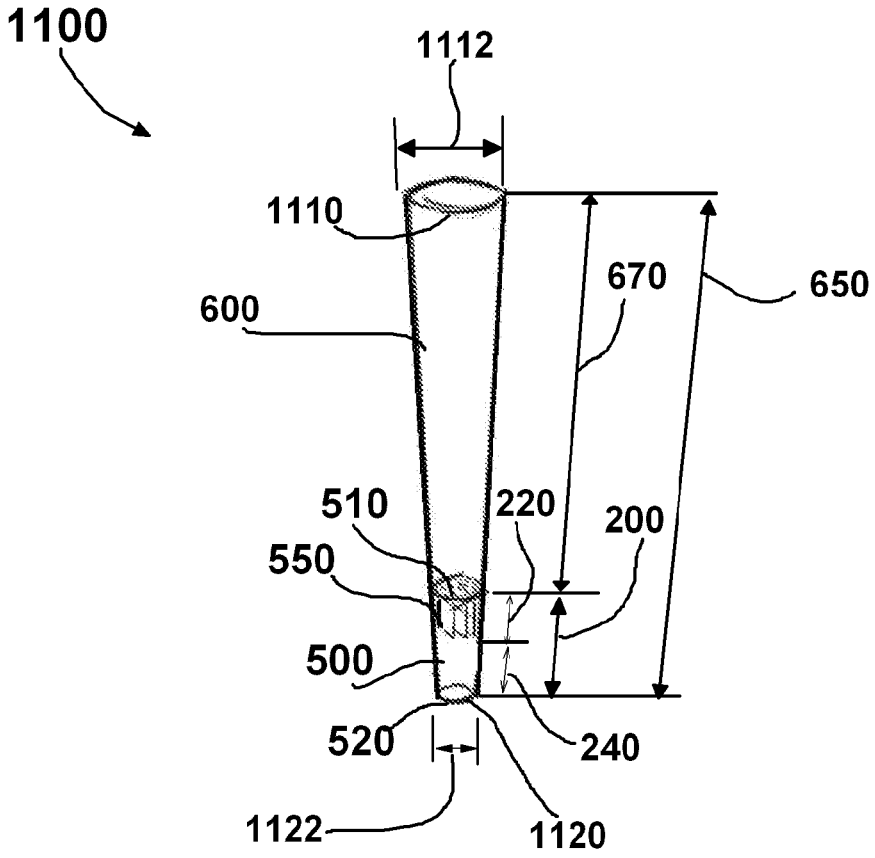
FIG. 16 is a perspective view of a smokable cone with a filter tip.

Using the above steps for the cylindrical filter tip 500, conical filter tip 500 can be used to make a cone 1100. FIG. 16 is a perspective view a cone 1100 for the consumption of smokable substances having sheet 600 of material comprised of tobacco, homogenized tobacco and/or natural leaf material such as plant leaves (e.g., banana, palm leaves, etc.) and the like rolled around conical filter tip 500. Sheet 600 forming cone 1100.

In various embodiments cone 1100 can be comprised of multiple sheets 600, 602, 604, 606, etc. Cone 1100 can be made to any desired length 650, and can have first end 1110, a second end 1120, an inner volume 1140. First end 1110 can have a width 1112, and second end 1120 can have a width 112. Width 1112 can be greater than width 1122. In various embodiments the ratio of the widths can be about 1.1, 1.2, 1.25, 1.3, 1.4, 1.5, 1.6, 1.75, 1.8, 1.9, 2.0, 2.25, 2.5, 2.75, 3.0, 3.5, 4.0, 4.5, 5.0, 6, 7, 8, 9, and 10. In various embodiments the ratio can be a range between any two of the above referenced ratios.

A conical filter tip 500 may be disposed within the first second end 1120 of cone 1100. Filter tip 500 can include filter section 550 and open section 570.

Packaging for Sale Cylindrical Tubes or Cones

Finished cylindrical tubes or cones 1100 can be packaged for sale in various embodiments of commercial packaging.

Figure 17:
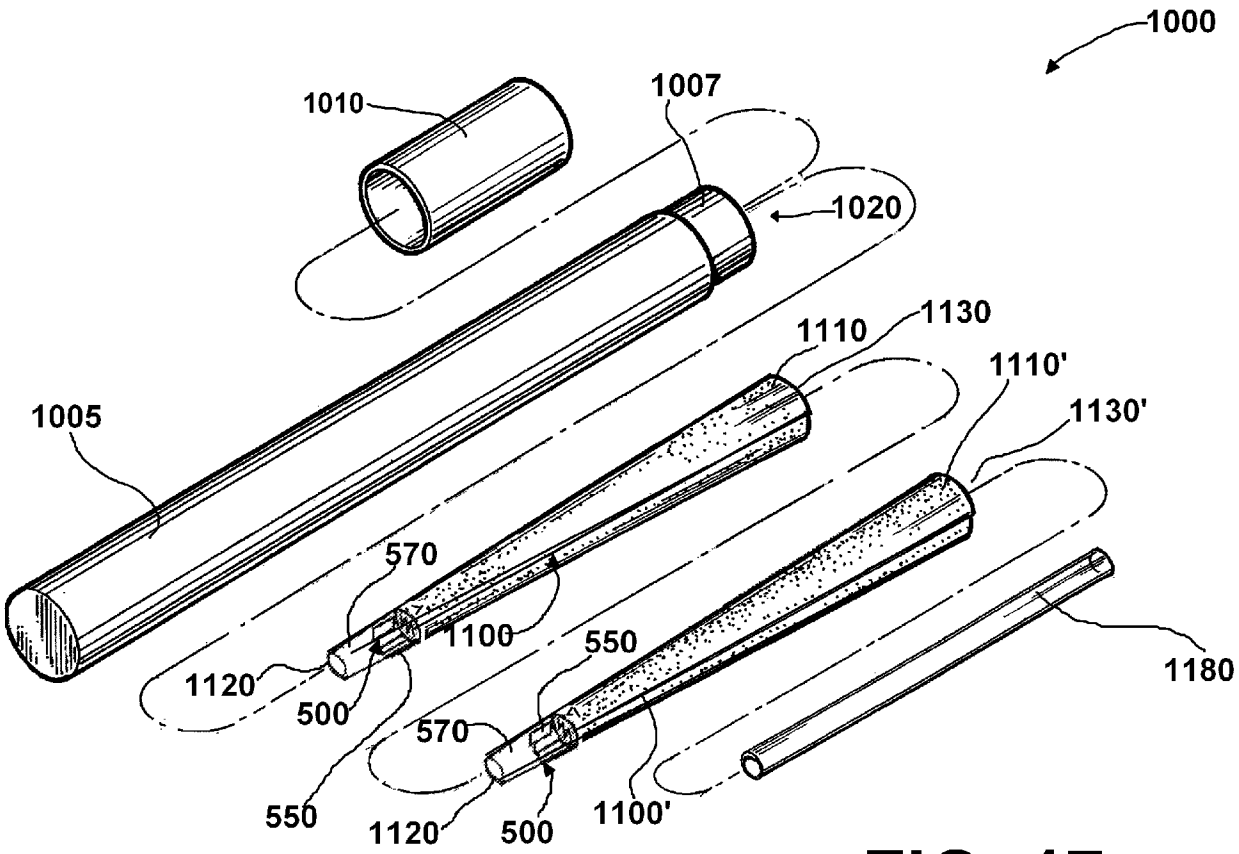
FIG. 17 is a perspective view showing a cone used with one or more of the filter tips disclosed herein and stored in a cylindrical storage tube with a removable cap, and a tamping/packing rod or straw.

FIG. 17 is a perspective view showing a cone 1100 used with one or more of the filter tips 500 disclosed herein and stored in a cylindrical storage tube 1000 having a base 1005, storage volume 1020, removable cap 1010, and a tamping/packing rod or straw 1180. Multiple nested cones 1100, 1100', 1100", etc. can be stored in storage tube 1000. When desired, the user can remove a cone 1100 and prepare a finished cigar or cigarette as will be described below.

Container 1000 can include a base 1005 and cap 1010. Base 1005 can have a shoulder 1007 for securing cap 1010. Base 1005 can also include an interior volume for storing one or more nested cones 1000, 1000', etc. Container 1000 can itself be packaged such as by shrink wrapping or other packaging Cylindrical storage tube 1000 will prevent the crushing (and drying out) of cones 1100, 1100', 1100", etc. until ready to use.

In an alternative embodiment multiple nested cylindrical tubes with filter tips 500 can be stored in storage container 1000. However, the individual multiple cylindrical tubes should have decreasing diameters to allow them to each be nested in the next larger diameter cylindrical tube.

Figure 18:
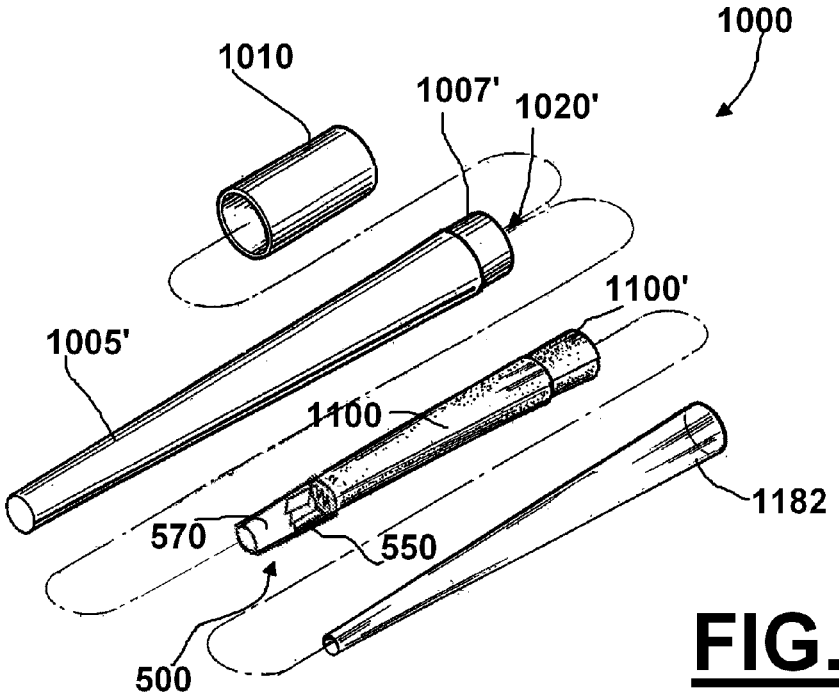
FIG. 18 is a perspective view showing a plurality of nested cones used with one or more of the filter tips disclosed herein and stored in a frusto-conical storage tube with a removable cap, and a tamping/packing rod or straw which also is frusto-conical in shape.

FIG. 18 is a perspective view showing a plurality of nested cones 1100, 1100', 1100", etc. used with one or more of the filter tips 500 disclosed herein and stored in a frusto-conical storage tube 1000' with a removable cap 1010, and a tamping/packing rod or straw 1182 which also is frusto-conical in shape.

Figure 19:
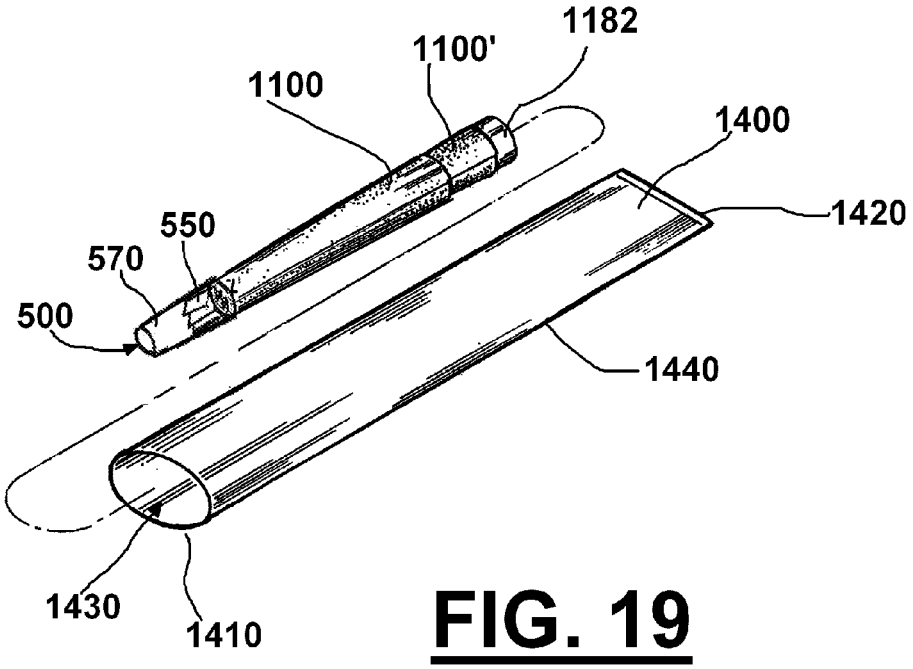
FIG. 19 is a perspective view showing a plurality of nested cones used with one or more of the filter tips disclosed herein and stored in a pouch, and a tamping/packing rod or straw, which also is frustoconical in shape, and which also provides support to the nested cones until used.

FIG. 19 is a perspective view showing a plurality of nested cones 1100, 1100', 1100", etc. used with one or more of the filter tips 500 disclosed herein and stored in a pouch 1400, and a tamping/packing rod or straw 1182, which also is frusto-conical in shape, and which also provides support to the nested cones 1100, 1100', 1100" until used.

Preparing a Cigar or Cigarette from a Cone or Tube with Filter Tip

FIGS. 20-24 schematically indicate the steps of preparing a finished cigarette or cigar 1600 with filter tip 500.

Figure 20:
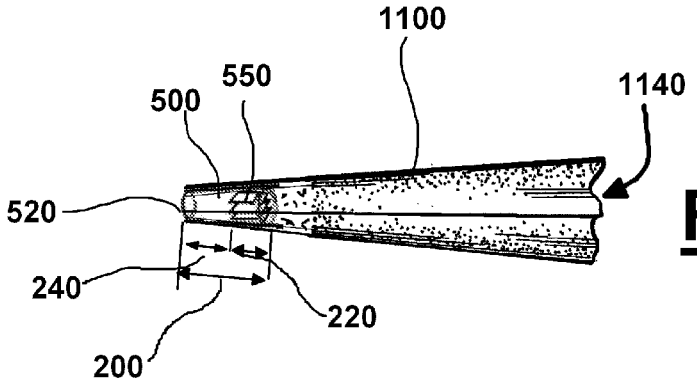
FIGS. 20-24 schematically indicate the steps of preparing a cigarette or cigar with the filter tip shown in FIGS. 5-8.

FIG. 20 is a side view of a cone 1100 having filter tip 500 and inner volume 1140.

Figure 21:
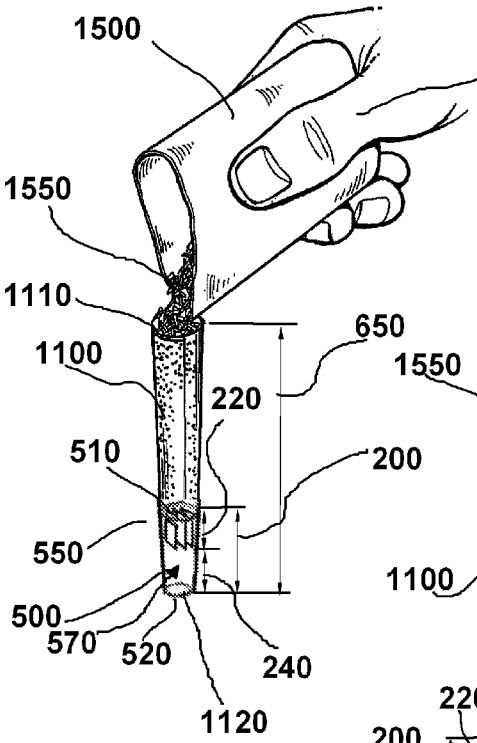

FIG. 21 shows the step of adding tobacco filler material to the inner volume 1140 of cone 1100. The inner volume 1140 is the space between first end 510 of filter tip 500 and first end 1110 of cone 1100. Filter section 550 of filter tip 500 will prevent tobacco filler material from passing through to open space 570 of filter tip 500.

Figures 22, 24:
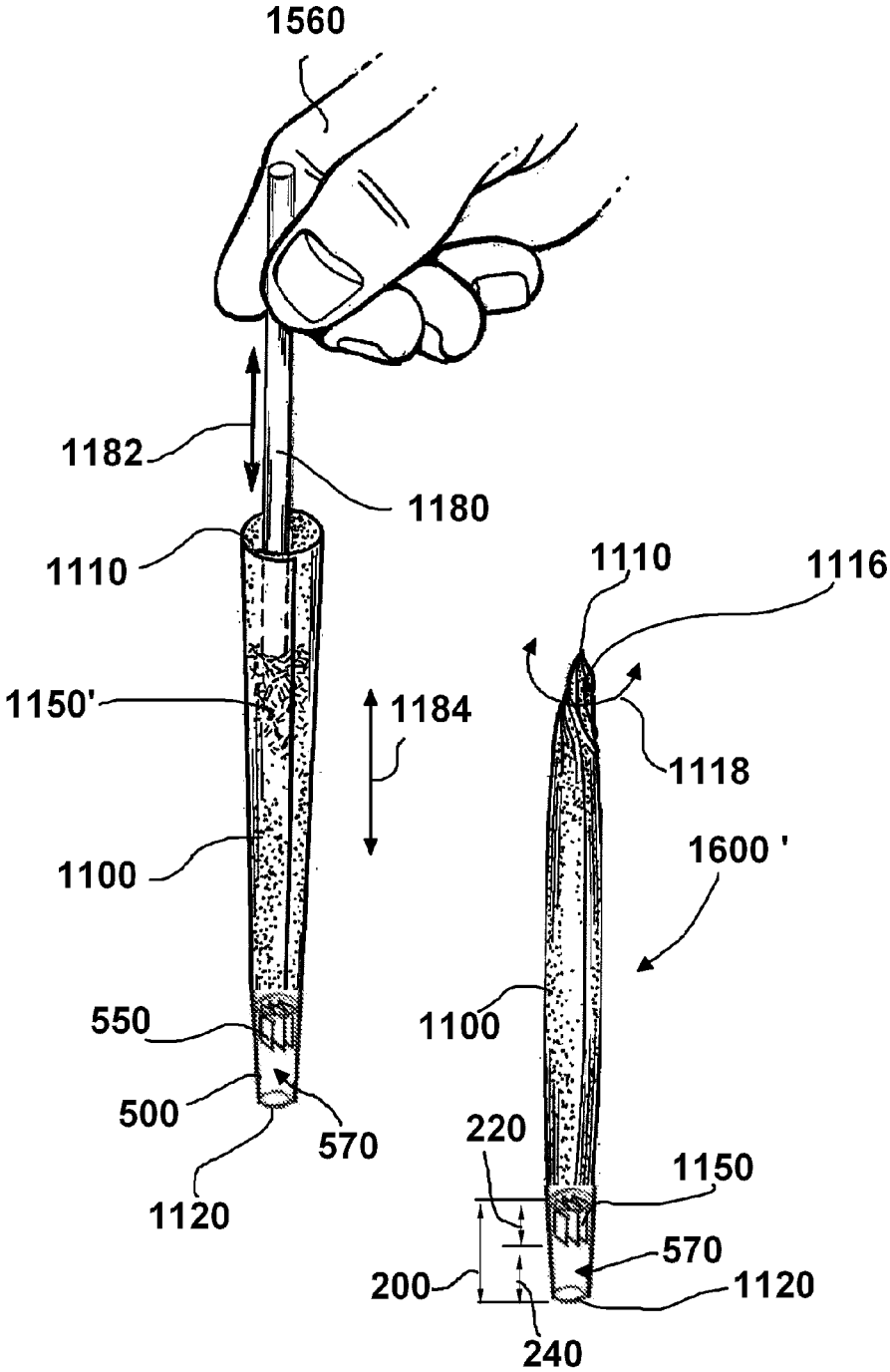

FIG. 22 shows the step of compacting the tobacco filler material 1150' added to inner volume 1140 of cone 1100. Arrows 1182 schematically indicate the use of tamper 1180 to pushed down tobacco filler 1150. Filter section 550 of filter tip 500 will prevent tobacco filler material from passing into open space 570 and second end 1120 of cone 1100. Arrows 1184 schematically indicate the use tapping second end 1120 of cone 1100 on a hard surface to compact tobacco filler 1150. During tapping filter section 550 of filter tip 500 will prevent tobacco filler material from passing into open space 570 and second end 1120 of cone 1100.

Various embodiments of tamping rod or straw 1180 can be used to pack or compact tobacco filler material 1550' into inner volume 1140 of cone 1100. Rod or straw 1180 may be a straw or stick, and may have different shaped ends to facilitate the tobacco filler compacting process—such as the frusto-conical shape of rod or straw 1180 in FIG. 18.

Figure 23:
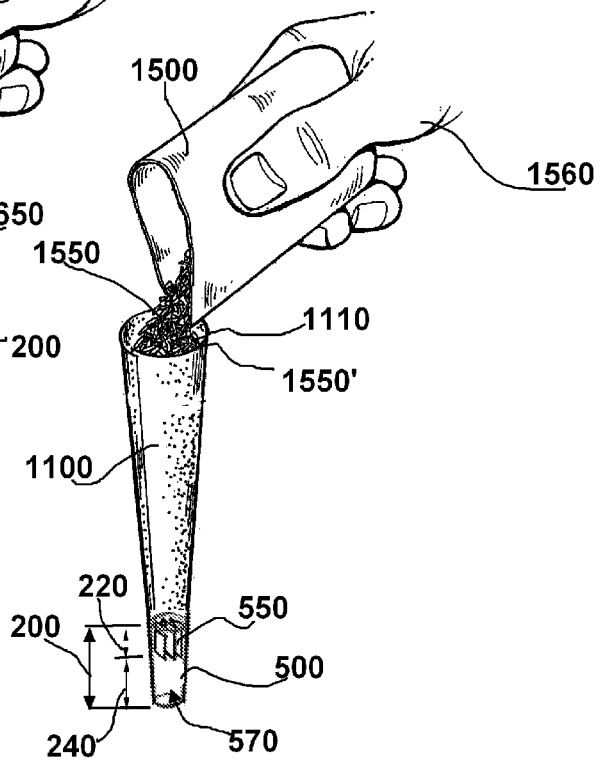

FIG. 23 continues the step of filling inner volume 1140 of cone 1100, after that compaction step of FIG. 22.

FIG. 24 shows the final step of twisting first end 1110 of cone 1100 (schematically indicated by arrows 1118) to close open volume 1140 and keep tobacco filler material 1150 compacted. The cigar or cigarette is now ready to smoke with a filter tip 500 at its second end 1120.

The following is a list of reference numerals used in this application.

LIST OF REFERENCE NUMERALS

| Reference Number | Description |
|---|---|
| 10 | smoking article |
| 100 | filter strip |
| 102 | encasing sheet |
| 106 | arrow |
| 110 | first side |
| 120 | second side |
| 130 | upper portion |
| 140 | lower portion |
| 150 | radius of curvature |
| 160 | length of filter tip/angle of circle |
| 170 | length of removed portion/angle of removed portion |
| 180 | length of remaining portion/angle of remaining portion |
| 200 | long height of filter tip |
| 220 | short height of remaining portion |
| 240 | height of removed portion |
| 300 | marked, etched, or crimped area |
| 310 | plurality of marked, etched, or crimp lines |
| 312 | zig zag arrow |
| 350 | perforation lines |
| 400 | removed portion |
| 402 | arrow |
| 500 | filter tip |
| 510 | first end |
| 520 | second end |
| 550 | filter portion |
| 570 | open portion |
| 600 | sheet |
| 602 | intermediate sheet |
| 604 | sheet |
| 605 | intermediate sheet |
| 606 | sheet |
| 610 | first side |
| 612 | front |
| 614 | rear |
| 620 | second side |
| 630 | third side |
| 640 | fourth side |
| 645 | adhesive or glue |
| 650 | height |
| 660 | width |
| 670 | open height |
| 1000 | storage tube or container |
| 1005 | storage compartment |
| 1007 | shoulder |
| 1010 | cap/closure |
| 1020 | interior |
| 1100 | cone or tube |
| 1110 | first end |
| 1112 | width of first end |
| 1116 | twisted end |
| 1118 | arrows |
| 1120 | second end |
| 1122 | width of second end |

-continued

LIST OF REFERENCE NUMERALS

| Reference Number | Description |
|---|---|
| 1130 | opening |
| 1140 | inner volume |
| 1150 | tobacco filler material |
| 1180 | straw or rod |
| 1182 | arrows |
| 1184 | arrows |
| 1200 | rod or straw |
| 1300 | packet |
| 1305 | base |
| 1310 | overlapping leaf |
| 1320 | opening |
| 1330 | interior storage volume |
| 1400 | packaging |
| 1410 | first end |
| 1420 | second end |
| 1430 | opening |
| 1440 | outside |
| 1500 | packaging for sale |
| 1550 | tobacco filler material |
| 1600 | finished cigar or cigarette |

All measurements disclosed herein are at standard temperature and pressure, at sea level on Earth, unless indicated otherwise. All materials used or intended to be used in a human being are biocompatible, unless indicated otherwise.

The foregoing description of presently preferred and other aspects of this invention has been presented by way of illustration and example. It does not present, nor is it intended to present, an exhaustive catalog of all structural and procedural forms by which the invention can be embodied. Variations upon and alterations of the described structures and procedures can be pursued without departing from the fair substance and scope of the invention consistent with the foregoing descriptions, and the following claims which are to be read and interpreted liberally in the context of the state of the art from which this invention has advanced.

The invention claimed is:

1. A method of fabricating a custom cigar or cigarette comprising the steps of:

(a) providing a first sheet of material, comprising tobacco, homogenized tobacco and/or natural leaf materials;

(b) cutting the first sheet of material to a desired size;

(c) forming the first sheet of material into a hollow cone, the hollow cone having a first end defining a first opening and a second end defining a second opening whereby the second opening has a diameter at least about 1.25 times greater than the diameter of the first opening;

(d) forming a filter tip from a filter strip of filter material wherein the formed filter tip includes: (i) a body having a wall surrounding a bore, the body having a longitudinal centerline and longitudinal length, along with upper and lower sections; (ii) the upper section including a filter portion having a longitudinal length; and (iii) the lower section having a longitudinal open space, the open space having a longitudinal length, the longitudinal length of the open space and the longitudinal length of the filter portion equaling the longitudinal length of the filter;

(e) placing the filter tip on the first end at the first opening of the hollow cone;

(f) wherein in step "d" and "e", the filter portion includes multiple folds that are positioned in between the open space and the hollow cone;

(g) wherein step "d" includes removing a section of the filter strip to provide an empty space and wherein the filter portion is formed by folding the filter strip multiple times adjacent the empty space; and (h) wherein the empty space becomes the open space when the filter strip is formed into said body and said filter portion.

2. The method of claim 1, wherein step "e" is completed before step "c".

3. The method of claim 1, wherein step "e" is completed at the same time as step "c".

4. The method of claim 1, wherein step "e" is completed after step "c".

5. The method of claim 1, wherein in step "e" the filter tip is placed in the first end of the hollow cone, wherein the first end of the filter tip is more closely placed to the second end of the cone, and the second end of the filter tip is more closely place to the first end of the cone.

6. The method of claim 1, wherein in step "e" the filter tip is cylindrical in shape.

7. The method of claim 1, wherein in step "e" the filter tip is conical in shape.

8. The method of claim 1, wherein in step "e" in the filter tip the longitudinal length of the open space is greater than the longitudinal length of the filter section.

* * * * *